United States Patent [19]

Sauer

[11] 4,346,361

[45] Aug. 24, 1982

[54] COOLING DUCT ARRANGEMENT FOR TRANSFORMER WINDINGS

[75] Inventor: George E. Sauer, Stockbridge, Mass.

[73] Assignee: General Electric Company, N.Y.

[21] Appl. No.: 194,050

[22] Filed: Oct. 6, 1980

[51] Int. Cl.[3] ..... H01F 27/10

[52] U.S. Cl. ..... 336/60

[58] Field of Search ..... 336/60, 185, 207, 55; 310/65

[56] References Cited

U.S. PATENT DOCUMENTS

| | | | |
|---|---|---|---|
| 1,424,016 | 7/1922 | Haworth | 336/60 |
| 1,523,378 | 1/1925 | Lennox | 336/60 X |
| 1,549,525 | 8/1925 | Cooney | 336/60 |
| 1,600,042 | 9/1926 | Holbrook | 336/60 |
| 2,756,397 | 8/1956 | Cederstrom et al. | 336/60 |
| 2,912,658 | 11/1959 | Paluex | 336/60 X |
| 3,500,272 | 3/1970 | Campbell et al. | 336/60 |

FOREIGN PATENT DOCUMENTS

| | | | |
|---|---|---|---|
| 54-104531 | 8/1979 | Japan | 336/60 |

*Primary Examiner*—Thomas J. Kozma
*Attorney, Agent, or Firm*—Robert A. Cahill

[57] ABSTRACT

A transformer cooling duct arrangement wherein the transformer winding sections are encompassed by an inner and outer insulating oil barrier and inner and outer blocks are employed to direct the oil flow in a labyrinth path throughout the winding sections. The inner oil block consists of a plurality of individual slotted blocks slidably mounted between corresponding pairs of radial spacers. The slidably mounted block arrangement allows the individual blocks to tightly contact the inner barrier during the transformer dry treatment process.

1 Claim, 3 Drawing Figures

COOLING DUCT ARRANGEMENT FOR TRANSFORMER WINDINGS

BACKGROUND OF THE INVENTION

U.S. Pat. Nos. 3,391,363, 3,548,354, and 4,028,653 all disclose transformers having radial cooling channels with means for guiding cooling fluid through the channels.

Like the cooling duct arrangement described in the aforementioned patents, most cooling ducts consist of spaces arranged between the winding sections in a transformer that allow for the continuous flow of cooling oil through the individual windings section for cooling and insulating purposes. The inner insulating oil barrier generally comprises the wall of the winding cylinder and the outer oil insulating barrier consists of a cylinder that encompasses the winding. In order to cause the oil to flow in a labyrinth pattern between the individual windings sections, the outer oil block is positioned against the outer barrier on one side and a passageway is provided between the opposite end of the outer oil block and the inner insulating barrier. The inner oil block is positioned against the inner insulating barrier such that a passageway is provided between the other end of the inner oil block and the outer barrier to allow for the passage of oil. During the transformer drying process, there is a tendency for the inner insulating barrier which is usually the winding cylinder, to shrink away from the winding and leave a space between the inner oil block and the inner insulating barrier. This space allows some of the oil to transfer directly up along the inner insulating barrier rather than flow in a labyrinth path between the windings causing a nonuniform distribution of cooling oil.

The purpose of this invention is to provide an inner oil block arrangement wherein the inner oil block does not move away from the inner insulating barrier during the transformer drying process.

SUMMARY OF THE INVENTION

The invention comprises the use of a plurality of individual oil block pieces slidingly retained within a pair of radial spacers. This arrangement allows the blocks to remain against the inner insulating oil barrier during the transformer drying process.

DESCRIPTION OF THE PREFERRED EMBODIMENT

Figure 1:
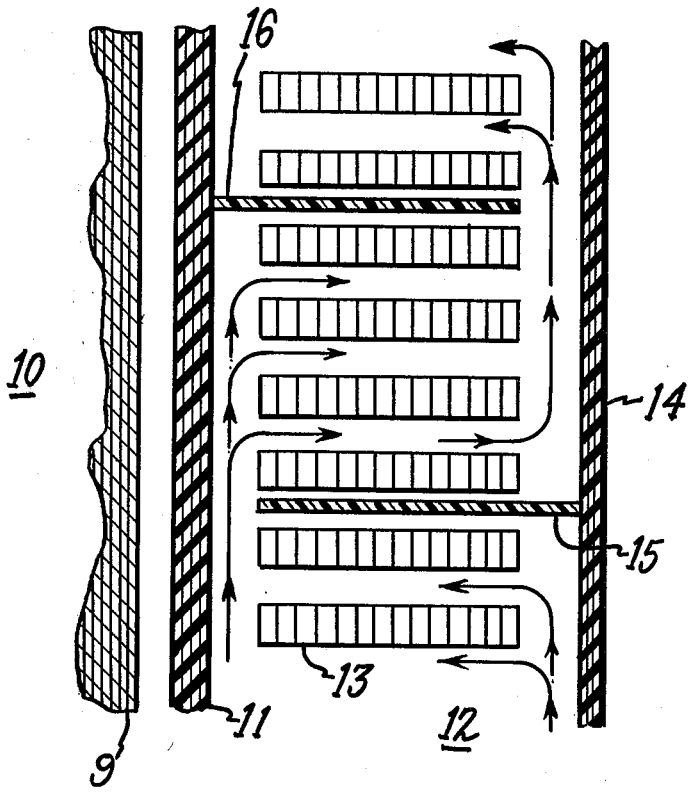
Fig. 1. PRIOR ART
FIG. 1 is a side sectional view of a winding arrangement containing inner and outer oil blocks according to the prior art.

The winding arrangement 10 commonly used in transformer windings is shown in FIG. 1 to consist of a winding cylinder 11 around a transformer core 9 or an inner winding (not shown) and including a plurality of winding sections 12 consisting of transformer cable 13 encompassed by an outer cylinder 14. The winding sections 12 are submerged in transformer oil for cooling and insulation purposes. In order to obtain the flow path indicated by arrows, an outer oil block 15 is situated against the outer cylinder 14 and a space is provided at the opposite edge for the transport of transformer oil. An inner oil block 16 is situated against winding cylinder 11 which comprises the inner insulating barrier and a space is left at the opposite end of inner oil block 16 to provide for the transport of transformer oil. As discussed earlier, the inner insulating barrier comprising winding cylinder 11 shrinks during the transformer drying process and pulls away from inner oil block 16 leaving a gap. Both outer oil block 15 and inner block 16 generally comprise a continuous flat disc of fiber board material.

Figure 2:
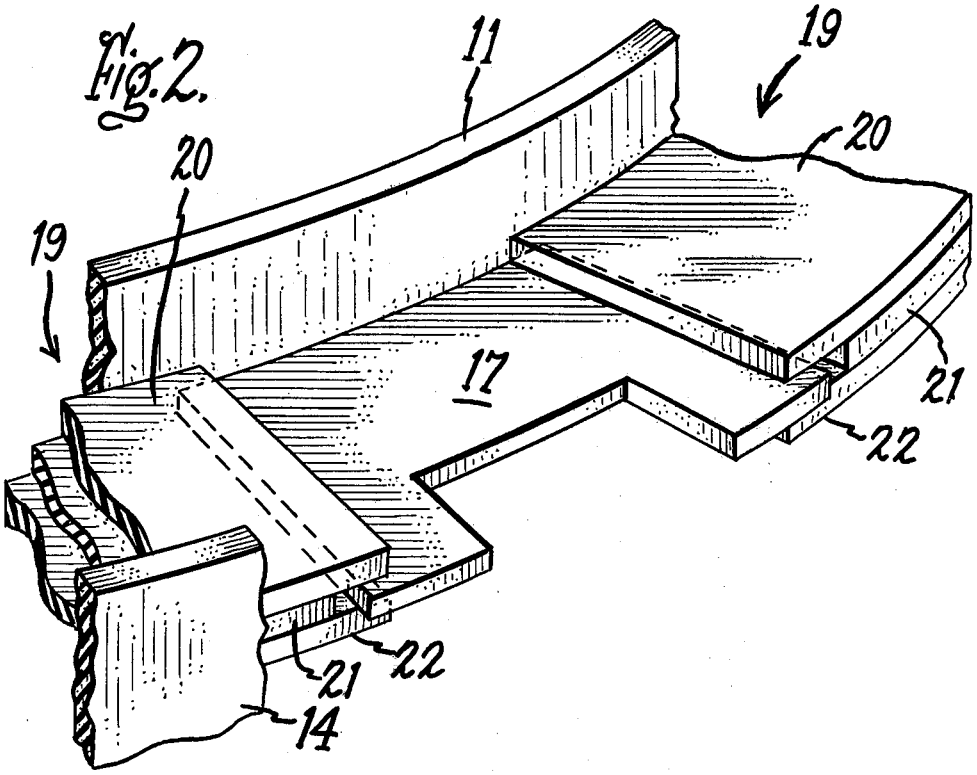
FIG. 2 is a top view of a sliding inner oil block arrangement according to the invention.

The cooling duct winding arrangement 10 of the invention is shown in FIG. 2 to consist of a plurality of individual sliding inner oil blocks 17 containing a slot 18 on the edge facing the outer insulating barrier comprising outer cylinder 14. Each individual sliding oil block 17 is spaced between a pair of radial spacers 19 such that a small portion of the radial spacer 19 overlaps the side edges of the individual sliding oil blocks 17. The purpose of slot 18 is to allow for the transport of oil between the individual windings sections.

Figure 3:
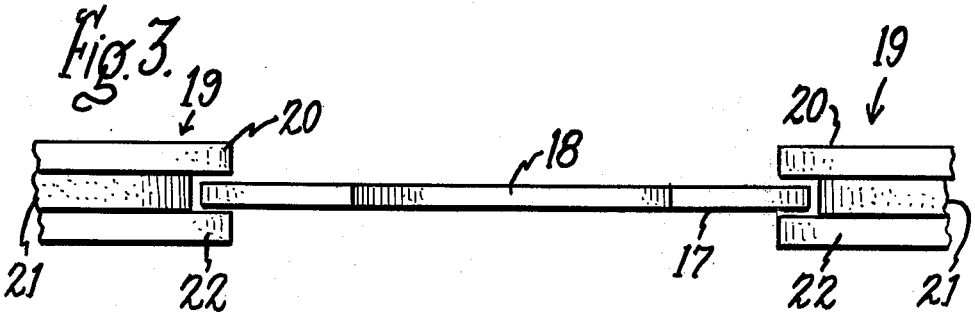
FIG. 3 is an edge view of the sliding inner oil block of FIG. 2.

The arrangement of sliding oil block 17 within radial spacers 19 is shown in FIG. 3 wherein each radial spacer 19 consists of a top part 20, center part 21, and bottom part 22. Center part 21 is sandwiched between top part 20 and bottom part 22 and the thickness of center part 21 is adjusted to be slightly greater than the thickness of sliding oil block 17 in order to allow sliding oil block 17 to move within space provided between top part 20 and bottom part 22. During the transformer drying process, when the inner insulating oil barrier comprising winding cylinders 11 shrinks, sliding oil blocks 17 are able to move along with winding cylinder 16 thereby keeping a tight oil seal between the edge of the sliding oil block 17 and the surface of the inner insulating barrier which comprises winding cylinder 11. The radial spacers 19 are also comprised of a pressboard material similar to that used for forming sliding oil blocks 17, inner insulating barrier 11, and outer insulating barrier 14.

What I claim as new and desire to secure by Letters Patent of the United States is:

1. A cooling duct arrangement for a transformer disk winding comprising, in combination:

a pair of inner and outer electrically insulating cylinders situated in a transformer tank containing dielectric oil for cooling and insulating a transformer disk winding arranged about a magnetic core and located between said inner and outer cylinders;

a plurality of inner and outer oil blocks alternatingly, radially disposed between disk winding sections, the outer edges of said outer oil blocks contacting the surface of said outer cylinder and the inner edges thereof terminating short of said inner cylinder, and the inner edges of said inner oil blocks contacting the surface of said inner cylinder, the outer edge of each said inner oil block having a slot, whereby said inner and outer oil blocks cooperate in promoting labywrinth flow of dielectric oil through the disk winding sections;

and a pair of spacers associated with each said inner oil block, each said spacer pair contacting the surface of said inner cylinder and providing opposed, radially extending grooves for slidably receiving the lateral edges of its associated inner oil block, thereby accommodating positional adjustment of said inner oil blocks accasioned by shrinkage of said inner cylinder during a transformer drying process and thus avoid distrubance of the contacting relationship between said inner oil blocks and said inner cylinder.

* * * * *